US007942029B2

(12) United States Patent
Bäumer et al.

(10) Patent No.: US 7,942,029 B2
(45) Date of Patent: May 17, 2011

(54) COIL BOX BETWEEN ROUGHING TRAIN AND FINISHING TRAIN IN A ROLLING MILL

(75) Inventors: Klaus Bäumer, Kreuztal (DE); Benhard Ehls, Hilchenbach (DE); Matthias Beuter, Bad Berleburg (DE); Thomas Runkel, Siegen (DE); Matthias Krüger, Hilchenbach (DE); Peter Schmitz, Ratingen (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 729 days.

(21) Appl. No.: 10/569,357

(22) PCT Filed: Jul. 19, 2004

(86) PCT No.: PCT/EP2004/008078
§ 371 (c)(1),
(2), (4) Date: Feb. 22, 2006

(87) PCT Pub. No.: WO2005/028136
PCT Pub. Date: Mar. 31, 2005

(65) Prior Publication Data

US 2007/0012082 A1 Jan. 18, 2007

(30) Foreign Application Priority Data

Aug. 22, 2003 (DE) ..... 103 39 191

(51) Int. Cl.
*B21C 47/16* (2006.01)

(52) U.S. Cl. ..... 72/146; 72/148; 242/595.1

(58) Field of Classification Search ..... 72/250, 72/39, 214, 146, 183, 251, 200, 202, 148, 72/205; 29/890.035, 890.35; 242/564.4, 242/564.5, 595.1, 558, 559
See application file for complete search history.

(56) References Cited

U.S. PATENT DOCUMENTS 1,691,703 A * 11/1928 Clarke ..... 72/40
(Continued)

FOREIGN PATENT DOCUMENTS

DE 101 38 857 2/2003
(Continued)

OTHER PUBLICATIONS

New Developments Expand Coil Box Application by T. Korabi et al. (Iron & Steel Eng. Dec. 1996).

*Primary Examiner* — Dana Ross
*Assistant Examiner* — Pradeep C Battula
(74) *Attorney, Agent, or Firm* — Andrew Wilford

(57) ABSTRACT

The invention relates to a method for expanding the use of a coiling and uncoiling station (coilbox) located between the roughing train and the finishing train for rolled strip material in hot-rolling mills. The use of said coilbox is expanded by impinging the coil that is to be uncoiled with a pressing force (F) which acts in the direction of the roller table (4) and/or placing the coil in a depression of the roller table in order to process smaller coil weights in a spikeless coilbox, and/or by combining, in a chronological and weight-related manner, the active transfer and passive transfer of a coil from a first coiling station to a second coiling station in order to increase the throughput especially at average coil weights in a spikeless coilbox, and/or by supplying heat to the strip upstream or downstream of the spikeless coilbox and/or thermally insulating the strip or the coilbox in order to variably increase and homogenize the strip temperature. The invention further relates to a correspondingly equipped device for carrying out said method.

14 Claims, 3 Drawing Sheets

U.S. PATENT DOCUMENTS

| | | | | |
|---|---|---|---|---|
| 3,803,891 | A | 4/1974 | Smith | |
| 3,805,570 | A | 4/1974 | Smith | |
| 4,047,416 | A * | 9/1977 | Johnson | 72/183 |
| 4,139,932 | A * | 2/1979 | Hanert et al. | 29/890.035 |
| 4,884,429 | A * | 12/1989 | Wilson | 72/250 |
| 5,310,131 | A | 5/1994 | Monaco et al. | |
| 5,580,012 | A * | 12/1996 | Soltysiak | 242/528 |
| 5,987,955 | A * | 11/1999 | Benner | 72/250 |
| 6,024,322 | A * | 2/2000 | Skelly et al. | 242/595.1 |
| 6,135,384 | A * | 10/2000 | Skelly et al. | 242/595.1 |
| 6,185,970 | B1 * | 2/2001 | Latzel | 72/201 |
| 6,295,852 | B1 * | 10/2001 | Kipping et al. | 72/39 |
| 7,171,946 | B1 * | 2/2007 | Watanabe | 123/399 |
| 7,181,946 | B2 | 2/2007 | Krueger et al. | 72/146 |
| 2006/0156779 | A1 * | 7/2006 | Ventosa | 72/214 |

FOREIGN PATENT DOCUMENTS

| | | |
|---|---|---|
| EP | 0 904 861 | 3/1999 |
| EP | 0 933 147 | 8/1999 |
| EP | 1 033 182 | 9/2000 |
| GB | 607 350 | 8/1948 |
| JP | HEI-07-148522 | 6/1995 |
| JP | HEI-11-254035 | 9/1999 |
| JP | 2003154403 | 5/2003 |
| JP | 2003200203 | 7/2003 |
| RU | 1809786 | 4/1993 |
| RU | 2003392 | 11/1993 |
| WO | WO 91/09694 | 7/1991 |
| WO | WO 03/101639 | 12/2003 |

* cited by examiner

COIL BOX BETWEEN ROUGHING TRAIN AND FINISHING TRAIN IN A ROLLING MILL

CROSS REFERENCE TO RELATED APPLICATIONS

This application is the US national phase of PCT application PCT/EP2004/008078, filed 19 Jul. 2004, published 31 Mar. 2005 as WO2005/028136, and claiming the priority of German patent application 10339191.6 itself filed 22 Aug. 2003, whose entire disclosures are herewith incorporated by reference.

FIELD OF THE INVENTION

The invention relates to a method and apparatus for increasing the use of a winding and unwinding station (coil box) between the roughing train and finishing train for rolled material in a hot-rolling mill.

BACKGROUND OF THE INVENTION

The use of a coil box in hot-rolling mills is known. The technology of the coil box is such that it can only work with a certain minimum weight of the strip. The minimum weight depends mainly from the strength of the material, the thickness of the strip, and the construction of the coil box. If the weight is below the minimum, there is insufficient friction between the unwinding rolls and the wound-up strip, the coil cannot be unwound. For this reason a strip coil box cannot be used below the minimum weight.

In a coil box the upstream station serves for winding up the coil. Unwinding is started with the coil in the upstream winding station. During unwinding, the coil is transferred to a downstream station. As long as the coil is being unwound in the upstream station, no more strip can be fed into the coil box; there must be some minimum pause in the strip-feeding operation. The minimum pause is dependent of the construction and operation of the coil box.

The residence time in the upstream station is dependent on the speed the material is fed in and pulled out. The maximum speeds are in turn a function of what the equipment can handle upstream and downstream of the coil box and from the production program, and can only be varied within narrow limits. The overall strip production rate is a function therefore of the minimum pause and the maximum material speed so that a coil box can only be used in a hot-strip mill under certain limits.

In the known coil boxes the transfer from the winding to the unwinding station is done by a mechanism. It can be a mandrel engaged in the coil or according to U.S. Pat. No. 5,987,955 by a method with a scale-like tipping action. Even other mechanisms are known as for example rollers on arms that push against the outside surface of the coil. This type of transfer is known as "active transfer" and is used for moving very big coils at very high speeds.

With a mandrelless transfer there is another method of transferring the coil from the winding to the winding station by pulling on the strip of the coil to be unwound from the downstream side. This pulling of the strip is typically done by the upstream equipment, but can also be done partially or fully by another device. In German 1,038,857 a procedure is described that prevents the coil from bumping against fixed abutments and being damaged. This type of transfer is hereinafter described as "passive transfer." Coils below a certain minimal weight cannot be shifted by passive transfer unless they are held down. The residence time in the upstream station is dependent on the coil weight and can be shorter or longer than when active transfer is employed.

With the known methods using active transfer it is not possible to effect, permit, or even force a passive transfer during an active transfer. In above-referenced U.S. Pat. No. 5,987,955 the scale-like tipping action creates, as a result of the shifting of the unwinding station upstream in the strip-travel direction, gaps in the roller path into which during an active transfer a passively shifting coil drops, with possible damage to the coil and the coil box. If the gap is closed by rollers shifted into place, these rollers must be shifted out of the way during movement of the other is rollers; otherwise there is once again a gap in the roller path.

In most applications a coil box produces a substantially higher and more uniform temperature in the strip. In spite of this the use of a coil box does not produce anything resembling an ideal temperature profile in the strip. The strip inside the coil box loses heat by radiation and contact with the rollers, in particularly at its outer turns.

Different temperatures and a nonuniform temperature profile over the length of the strip are disadvantageous. With inadequate or no strip-thickness control the temperature differences lead to different rolling pressures in the finishing train and to variances of strip thickness along the length of the strip. Uniformity of thickness is however one of the most important quality features in strip finishing.

OBJECTS OF THE INVENTION

Taking the above-given state of the art into account, it is an object of the invention to propose a technical solution whereby a coil box can handle substantially smaller coils weights. It is also an object of the invention to provide means whereby the strip throughput of the coil box is substantially increased. This would apply in particular to continuous trains with low roller speeds both upstream and downstream of the coil box and would possibly allow a small spacing between the last roll stand upstream of the coil box and the intake of the coil box. Means for increasing the strip throughput are particularly important for small coil weights in a coil box.

In addition it is an object of the invention to provide means whereby the coil box produces strip with a higher and more uniform temperature.

SPECIFIC DESCRIPTION

According to the invention:

1. In order to reduce minimum weight it is suggested that a mandrelless coil box have a hold-down assembly that on the one hand increases the friction between the coil and the winding rolls that is a function of the downward force and that on the other hand prevents by means of a particular orientation an unwanted transfer of the coil.

Figure 1:
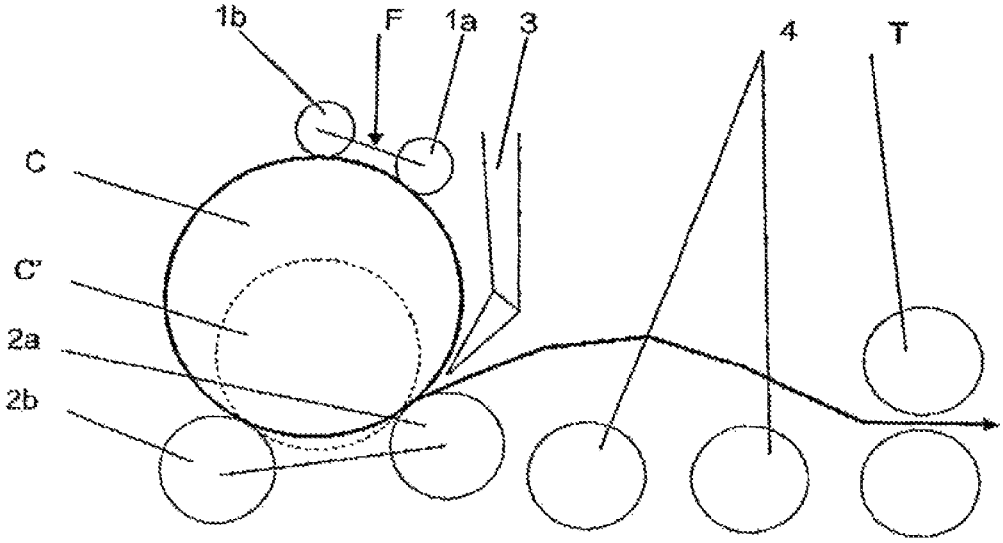
FIGS. 1 and 2 are schematic side views of the system according to the invention in two different positions.

On winding the coil according to FIG. 1 immediately upstream of and at the start of transfer of the coil from the upstream winding station 2*a*, 2*b* to the downstream winding station 4 there is a vertically adjustable hold-down device formed by rollers 1*a* and 1*b* exerting a hold-down force F.

The rollers 1*a* and 1*b* of the hold-down device or rollers 2*a* and 2*b* of the winding station or all of them can form a cradle in which the coil C or C' is held even when tension is exerted by an output-side drive T. This prevents a coil, even when fairly light, from being pulled against the coil opener 3. Once the coil opener 3 is lifted, the cradle is opened by raising and lowering of the appropriate rollers.

In addition the rollers 1*a* and 2*b* are shiftable selectively transverse to the material-travel direction and can each be made as two rollers with a central bearing. The edges of the rollers are rounded to prevent grooving the workpiece.

Figure 2:
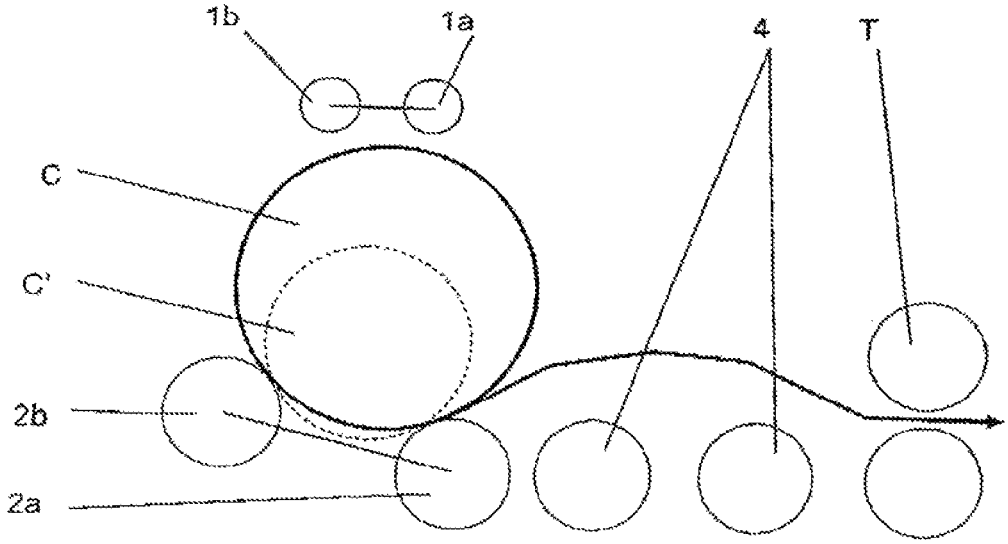

According to FIG. 2 dropping the roller 2*a* and lifting the roller 2*b* effects the earliest possible passive transfer of the coil C or C' toward the drive rollers T.

The method of dynamically lifting and lowering the hold-down device according to the roundness of the coil is described below:

The inertia of the hold-down device is compensated for by an appropriate regulation of the hold-down force such that the hold-down force F effective downwardly on the coil is independent of the roundness of the coil and is generally constant. Compensation of the hold-down force is effected by taking into account the vertical displacement speed of the hold-down device caused by an out-of-round condition of the coil. The hold-down force is increased or decreased appropriately by the amount of the resulting acceleration forces.

The maximum hold-down force for the different materials and operational methods is determined by tests, is stored in a controller, and is called up later for use.

In this manner the invention can work with strip of much lighter weights than the hitherto known coil boxes. The application range of the coil box is extended to a minimum specific coil weight (coil weight to coil width) of 2 kg/mm.

2. In order to increase the material throughput of a coil box according to the invention a combination of active and passive transfer in a mandrelless coil box is proposed. To this end at any point an active transfer can become a passive transfer. In this manner the residence time in the upstream station and the necessary minimum pause between two strips is reduced and the material throughput of the coil box is increased.

Figure 3:
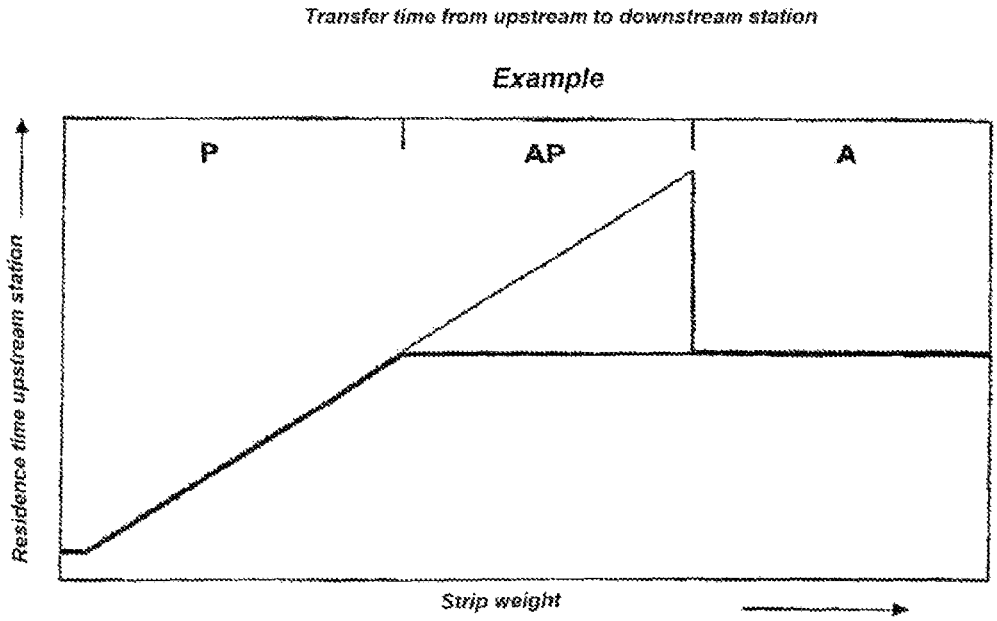
FIG. 3 is a diagram illustrating the system of this invention.

FIG. 3 shows the residence time in the upstream station for an active transfer there is a fixed time show in diagram region A. This region is valid for heavy strip.

for a passive transfer the time varies depending on the coil weight. The amount of time increases from a minimal value in the diagram region P (low coil weight) to the value of the upper line in diagram region AP (average coil weight). In the region AP hitherto an active transfer could not be used since the reduction in weight during unwinding and resulting from material tolerances can cause an undesired passive transfer.

Figure 4:
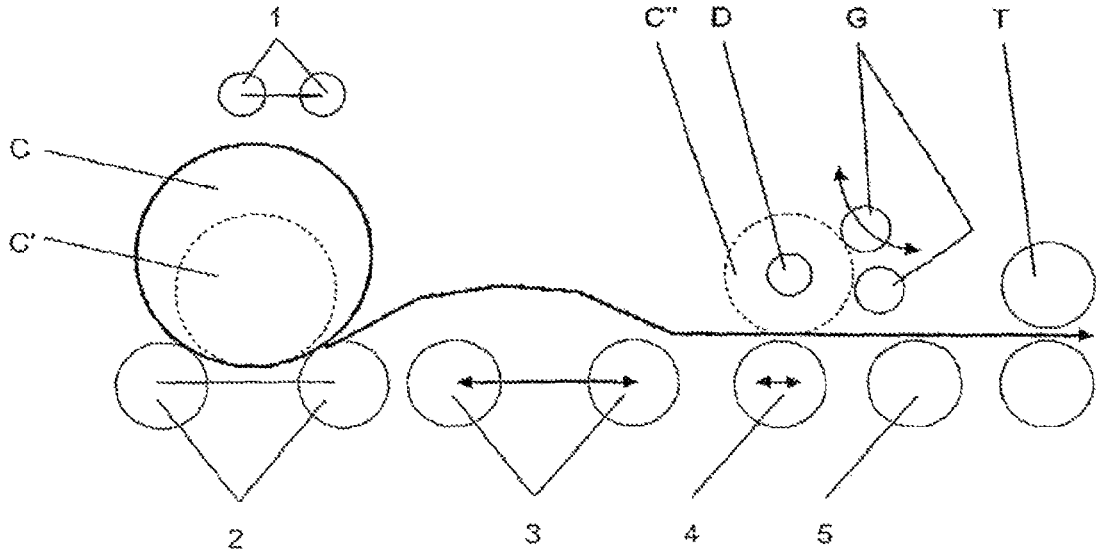
FIG. 4 is another schematic side view of the system of the invention.

The arrangement and movement of the rollers aligned horizontally in the strip travel direction are shown in FIG. 4. The coil C or C' sits on the pivotal rollers 2 and is wound up downstream by the drive rollers T. The coil is transferred to the pivotal and movable rollers 3 and up to one or more stop rollers G. After a mandrel D is inserted, the coil is completely unwound.

The advantage of the method of the invention is that an active transfer is combined with a passive transfer and thus even during an active mandrelless transfer a passive transfer is forced or permitted. In this manner the transfer time in the diagram region AP is reduced for average strip weights to the lower line. The now possible combination of the two methods shortens the residence time of average coils in the upstream station.

Even the spacing of the rollers 3, 4, and 5 (as well if necessary as further rollers) is reduced so that the coil at any time can be transferred down to the stop rollers G without falling into a gap between rollers.

In addition one or more rollers 4 can be shiftable horizontally in the strip-travel direction in order to close any gap between rollers. With shiftable rollers 4 there are as compared to pivotal rollers no roller-path gaps.

The method of active transfer can be further developed in that the rollers 2, 3, 4, and 5 always are at the same level. In this manner at any time during active transfer a coil can be passively transferred without substantial vertical movement.

To brake the coil one or more stop rollers G are used. The stop rollers G can be vertically adjustable and thus set at the technically necessary height level with the center of the coil.

With at least one stop roller G the last part of the coil being unwound is held back and the mandrel D in the center of the coil opens the last turns of the coil.

Use of the hold-down device 1 makes it possible to conform with certain lighter coils to the diagram region P and the lower line AP (FIG. 3). Such a coil would normally be impossible to deal with because of its weight without a hold-down device.

A method of advance calculation of the transfer method and the minimum pause is also used. In this method the actual parameters of already handled strip material are used and serve for predicting the minimum pause.

Finally the advance calculation of the minimum pause controls the entry time of the leading end into the roll stand upstream of the coil box. This is particularly significant for continuous rolling mills for exploiting the minimum pause and to achieve a high material throughput, since before completing treatment of the actual strip in the coil box the next strip can already be on the way in the continuous mill.

A modified control of the output driver allows an earlier start of the transfer. As soon as the strip to be unwound has reached the driver and is gripped by the drive rollers, transfer from the upstream to the downstream station is initiated.

Finally a third winding station can be used so as further to shorten the residence time in the upstream station. The strip is wound up in the upstream station. Once the strip is wound up, the coil is moved to the middle station. The unwinding starts there. During the unwinding the coil is transferred to the downstream station. Since the upstream station is no longer needed for any part of the unwinding operation, this upstream station is more quickly freed for the following strip.

The combination of three winding stations with a transfer without a mandrel from the upstream to the middle and from the middle to the downstream station is particularly advantageous. The transfer can be done by a scale-like tipping action or with a push roller oriented level with the central axis or a combination of these methods.

The prior-art disadvantages of a coil turning on a mandrel and the loss of the position of the end of the strip with a mandrelless transfer from the upstream to the downstream station are avoided.

With the system of the invention unlike the hitherto known solution a coil box can achieve a substantially greater material throughput. The inventive use of a production program even for light coils can produce an annual increase in production of 3 million and more tons.

3. According to the invention the coil box has devices for actively and passively variably raising and equalizing the strip temperature in particular by heating the strip (e.g. an inductive heater or a tunnel-type gas oven). The temperature of cool strip regions (such as the leading and trailing ends and outer edges) can be raised with respect to the other regions. In this manner the actual temperature differences are decreased and at the same time the average temperature is increased.

When a coil box is combined with a heating apparatus the travel speed of the strip in the heater is reduced so as to increase the temperature of the cooler parts of the strip. The strip-travel speed can be selected independently of the speed of the roll stands upstream and downstream of the coil box, that is for the trailing end of the strip with a heater downstream of the coil box and for the leading end of the strip with an upstream heater. The heating capacity can be increased for colder regions transversely of the strip and reduced for hotter regions. Devices can be provided between the heaters and the coil box for laterally guiding and segregating regions of the strip.

In addition the reliability of the heaters can be improved by a straightener on the output side of the coil box or by a separate driven straightener upstream of the heater. The straighteners eliminate waviness and folding of the strip in the coil box.

To avoid rolling-in scales and to increase the strip quality, upstream of or inside the straightener there is a descaling apparatus, for example a spray beam. The rollers of the straightener can be provided with scrapers for removing and getting rid of foreign matter, for instance scales.

Furthermore the radiant loss of heat inside the coil box can be reduced by the application of variable-width heat-blocking hoods. Shortening the coil box reduces travel time and thus decreases the time for the material to radiate off heat and thus get cool. In addition heat-blocking hoods can be provided upstream and downstream of the coil box or its rollers.

Furthermore with winding and unwinding speeds that are faster than the rolling speeds of the rolling stands upstream and downstream of the coil box the travel time on the roller sis reduced and the radiant loss of heat is also reduced.

As a result of the method of the invention there is a substantially higher material temperature that is more uniform along the strip. This is important for the rolling to a final thickness of between 0.5 and 2.0 mm.

The individual features described above at 1 to 3 can be combined with one another.

The standard operating range of a coil box (see FIG. 5) is inside a diagram area O. This region is also covered according to the system of this invention. By appropriate combination of the features described above at 1 to 3 it is also possible to increase the range of application of a coil box beyond that of any one feature.

Figure 5:
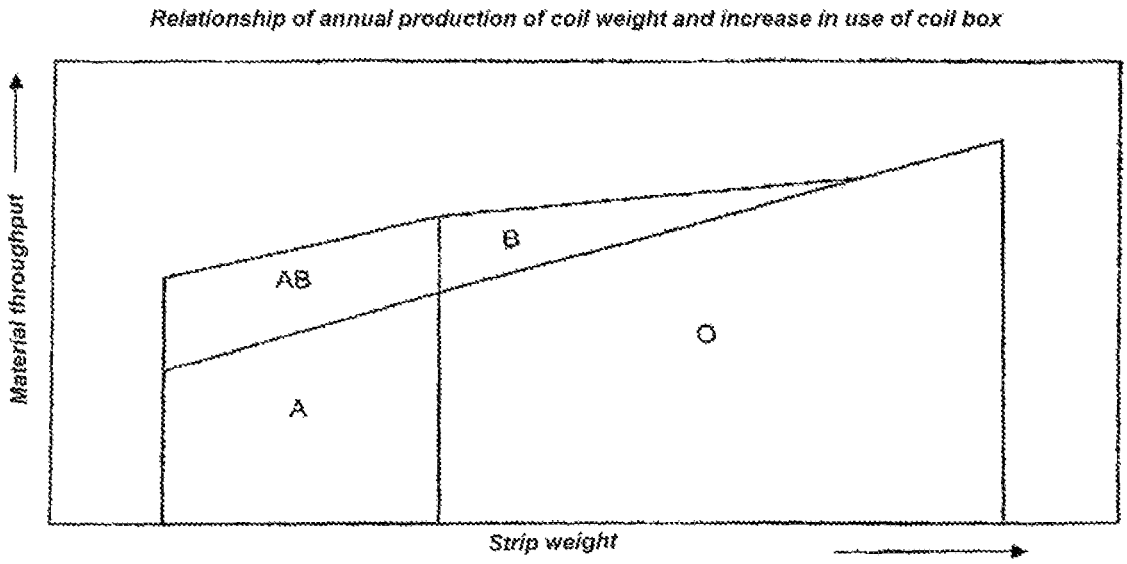
FIG. 5 is another diagram illustrating the instant invention.

If only the features for decreasing the minimum weight of the strip according to feature 1 are used, the ability to handle lighter coils is increased (FIG. 5, area A). Since however with lighter coils the maximum material throughput of a coil box decreases, there is here the unavoidable disadvantage of decreased throughput.

If only the features for increasing material throughput according to feature 2 are used, the invention is only usable with is average coils (FIG. 5, area B).

By combining the features of the invention to reduce the minimal weight of the coil with the features for increasing the material throughput, strips of lighter weight can be handled in a coil box at a greater throughput (FIG. 5, areas AB and also AB).

It is therefore true that only some of the inventive features detailed at 1 to 3 produce a meaningful expansion of the range of applicability of the coil box in practical application.

In general the features of the invention have the following advantages:

The minimal weight of the strip being handled can be substantially reduced. Thus a coil box can be used even with light coils.

The maximum throughput of a coil box can be substantially increased. In this manner a coil box can be used in rolling mills with high material throughput rates.

Temperature differentials and uneven temperatures in the strip can be substantially reduced. The radiant heat losses are reduced and if necessary compensated for. This makes possible the application to hot-strip rolling to final thicknesses between 0.5 and 2 mm.

By combining the individual features of the invention to decrease the minimal weight or to increase the material throughput one achieves a substantial increase in the application range of a coil box in particular for production programs with low coil weights and high material throughput.

The invention claimed is:

1. A method of increasing the applicability of a winder for forming and unwinder for unwinding multiturn coils of strip between a roughing train and a finishing train for the strip material in a hot-strip mill, the method comprising the steps of:

to handle lighter coils in a mandrelless coil box, pressing a multiturn coil to be unwound downward in the unwinder by hold-down rollers with a hold-down force against a roller cradle;

adjusting the level of hold-down force in accordance with coil roundness, coil composition, and operational method; and thereafter orienting and moving the rollers spaced apart in the strip-travel direction such that at first there is a passive transfer of the partially unwound coil downstream followed by a braking of the coil by at least one stop roller and a holding-back of the coil by insertion of a mandrel into the partially unwound coil.

2. The method according to claim 1 wherein by means of the hold-down force the friction between the coil and the unwinding rollers is increased or an unintended transfer of the coil is prevented by a predetermined shape of the roller cradle.

3. The method according to claim 1 wherein by dropping the roller and raising the roller the earliest possible passive transfer of the coil toward the drive rollers is initiated.

4. The method according to claim 1 wherein to calculate in advance the transfer method and the minimum pause of the coil handling the actual results of already handled strip material are used.

5. The method according to claim 1 further comprising the step before starting the transfer procedure from the upstream to the downstream winding station of starting an output-side driver to apply a predetermined strip tension.

6. The method according to claim 1, further comprising the step of controlledly applying heat by increasing or decreasing it along or transversely to the strip-travel direction.

7. An apparatus for increasing the applicability of a winder and unwinder in a mandrelless coil box between a roughing train and a finishing train for a multiturn coil of strip material in a hot-strip mill, the apparatus comprising:

an array of rollers forming in the box a roller cradle adapted to support the coil;

hold-down rollers above the cradle;

a retaining mandrel positionable in a coil downstream of the cradle;

for initially unwinding a lighter coil, means for pressing the hold-down rollers down against the lighter coil to be unwound with a hold-down force against the roller array while adjusting the level of hold-down force in accordance, with coil roundness, coil composition, and operational method; and for thereafter unwinding the partially unwound coil, moving the partially unwound coil downstream from the cradle and inserting a mandrel into the partially unwound coil.

8. The apparatus according to claim 7, further comprising means for pivoting the rollers and means for adjusting the spacing or height of the rollers.

9. The apparatus according to claim 7 wherein the coil box is provided on its output side with an adjustable driver.

10. The apparatus according to claim 7 further comprising a straightener downstream of the coil box or upstream of the strip heater.

11. The apparatus according to claim 7, further comprising at least one descaler upstream of or inside the straightener.

12. The apparatus according to claim 7 wherein the straightener is provided with at least one cleaner for its straightening rollers.

13. The apparatus according to claim 7 wherein the apparatus has three winding stations for mandrelless transfer of the coil.

14. In a method of handling strip steel where a multiturn coil of the strip steel is formed in a mandrelless coil box and unwound while in the box, the steps comprising:

supporting the coil in the box on a plurality of support rollers without fitting a mandrel to the coil;

pressing holddown rollers down against the coil in the box with holddown rollers to increase friction between the coil and the support rollers;

rotating the support rollers of the coil pressed by the holddown rollers against the support rollers to unwind the coil; and when the coil is substantially completely unwound, bracing the coil in a downstream direction against stop rollers and inserting a mandrel into the coil while final turns of the coil are pulled out.

* * * * *